US006929172B2

(12) United States Patent
Bates et al.

(10) Patent No.: US 6,929,172 B2
(45) Date of Patent: Aug. 16, 2005

(54) SEVERABLE CARTON WALL

(75) Inventors: Aaron Bates, Marietta, GA (US); James R. Oliff, Douglasville, GA (US)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/179,785

(22) Filed: Jun. 21, 2002

(65) Prior Publication Data

US 2003/0234285 A1 Dec. 25, 2003

(51) Int. Cl.[7] ..... B65D 17/00
(52) U.S. Cl. ..... 229/244; 229/122.1; 221/305
(58) Field of Search ..... 211/305, 302, 211/303, 122.1, 221, 241, 242; 229/244, 122.1, 221, 241, 242

(56) References Cited

U.S. PATENT DOCUMENTS 3,263,861 A * 8/1966 Carr ..... 221/302 X
3,335,940 A * 8/1967 Dykes ..... 206/427
3,356,279 A * 12/1967 Root ..... 206/427
4,396,143 A 8/1983 Killy
5,265,798 A 11/1993 DeMaoi et al.
5,292,059 A 3/1994 Oliff
6,155,480 A * 12/2000 Botsford et al. ..... 229/122.1
6,176,419 B1 1/2001 Holley, Jr.
6,484,903 B2 * 11/2002 Spivey et al. ..... 211/303

* cited by examiner

*Primary Examiner*—Tri M. Mai
(74) *Attorney, Agent, or Firm*—Tsugihiko Suzuki

(57) ABSTRACT

A frangible line defines a line of severance by extending across a carton wall that has a seam. The frangible line is extensively weakened along a predetermined segment where it traverses the seam. Preferably, the predetermined segment is extensively weakened by substantially disjoining the panel regions on either side of the line. Disjoinder is preferably achieved by making the predetermined segment a cut line.

21 Claims, 4 Drawing Sheets

SEVERABLE CARTON WALL

CROSS-REFERENCE TO RELATED APPLICATIONS (Not Applicable)

STATEMENT REGARDING FEDERALLY-SPONSORED RESEARCH AND DEVELOPMENT (not applicable)

1. Technical Field of the Invention

The invention relates to cartons, and more particularly to cartons having a wall severable along a frangible line of severance wherein the line of severance traverses a joinder of panels.

2. Background of the Invention

Cartons made of flexible material, such as paperboard, are often used in a manner that requires that one of the carton walls be partially or fully severed to gain partial or full access to the interior of the carton. Sometimes access is for the purpose of removing or depositing articles such as beverage cans or bottles. Typically, the carton is severable along a frangible region or line such as a perforated line or tear strip. An example of a carton wherein at least a portion of the carton wall is severable is U.S. Pat. No. 5,518,111.

In order to be effective for the packaging of articles, a carton typically must be constructed in some type of arrangement wherein a partially or fully enclosed structure is formed. For example, a quadrilateral-shaped tubular structure such as the carton of U.S. Pat. No. 5,518,111. Cartons are typically erected from flat sheets known as blanks. To form such a closed carton structure, it is typically necessary to join certain regions of the blank in some fashion. The ends of carton panels are typically joined by adherence such as gluing. A seam is generally formed where the panel ends overlap.

Often, it may be desirable to sever a carton wall across a joinder of panels. It is generally more difficult to tear across a carton seam than an un-joined carton wall. The seam is essentially a reinforced region because it is multiple-ply and any adhesive used typically adds its own resistance to shearing. A carton wall may de-laminate, that is, come apart in layers, or otherwise have portions that give way in an undesirable manner due to the resistance to shearing presented by a seam. Thus, it can be appreciated that it would be useful to have a means for severing a carton wall across a seam.

BRIEF SUMMARY OF THE INVENTION

In accordance with a preferred embodiment of the invention, a frangible line defines a line of severance by extending across a carton wall that has a seam. The frangible line is extensively weakened along a predetermined segment where it traverses the seam. Preferably, the predetermined segment is extensively weakened by substantially disjoining the panel regions on either side of the line. Disjoinder is preferably achieved by making the predetermined segment a cut line.

In accordance with another aspect of the preferred embodiment of the invention, the predetermined extensively weakened segment is arcuate.

In accordance with another aspect of a preferred embodiment of the invention, in the portion of each panel that overlaps to form the seam, the frangible line terminates in an arcuate extensively-weakened segment. The arcuate segments are disposed to substantially align with one another when the seam is formed.

In accordance with a further embodiment of the invention, the arcuate segments are at least slightly offset from one another when the seam is formed.

In accordance with still another embodiment of the invention, the terminal end of an extensively weakened line segment of a panel is frangibly joined to the panel adjacent the edge of the panel. Preferably joining is by means of a nick member.

Other advantages and objects of the present invention will be apparent from the following description, the accompanying drawings, and the appended claims.

BRIEF DESCRIPTION OF THE SEVERAL VIEWS OF THE DRAWINGS

Exemplary embodiments of the invention will now be described by way of example only, with reference to accompanying drawings in which.

DETAILED DESCRIPTION OF THE INVENTION

Figure 1:
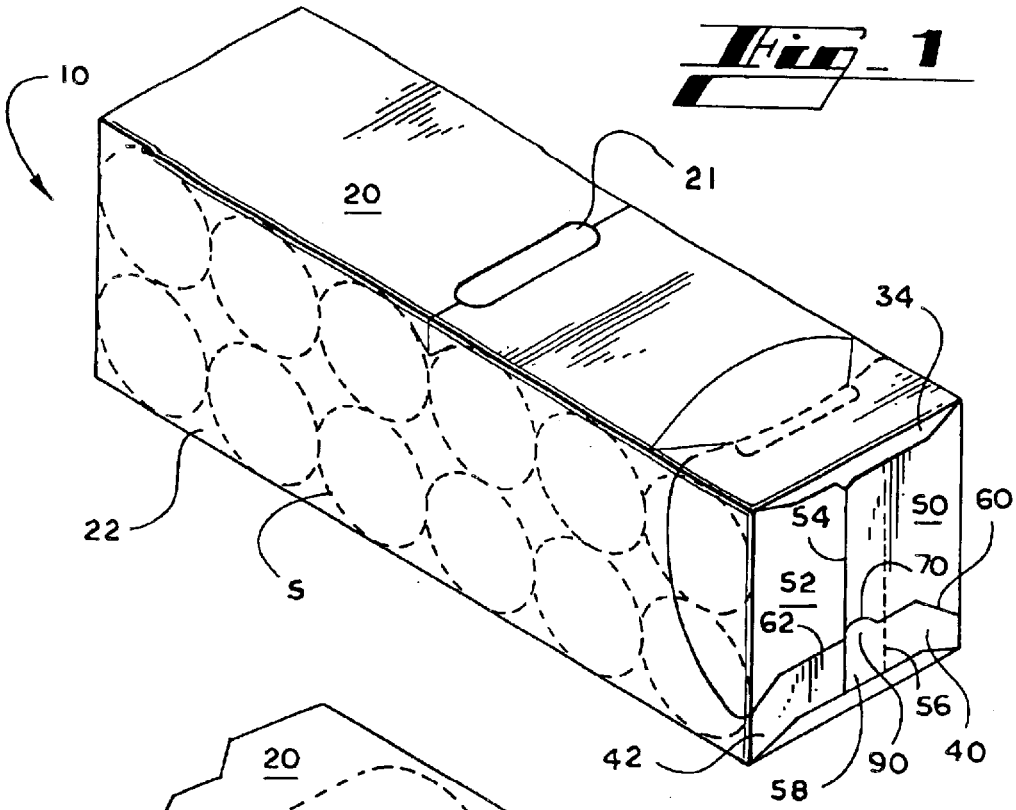
FIG. 1 is a perspective illustration of a carton having a severable wall in accordance with a preferred embodiment of the invention.

Throughout the drawings, the same reference numerals are used to denote the same or like features of the invention.

Referring first to FIG. 1, therein is illustrated a carton 10 having a severable carton wall in accordance with the teachings of the present invention. For purposes of describing the invention, an elongated tubular carton 10 is illustrated. However, the teachings of the invention are not limited to any particular carton shape or configuration.

Figure 5:
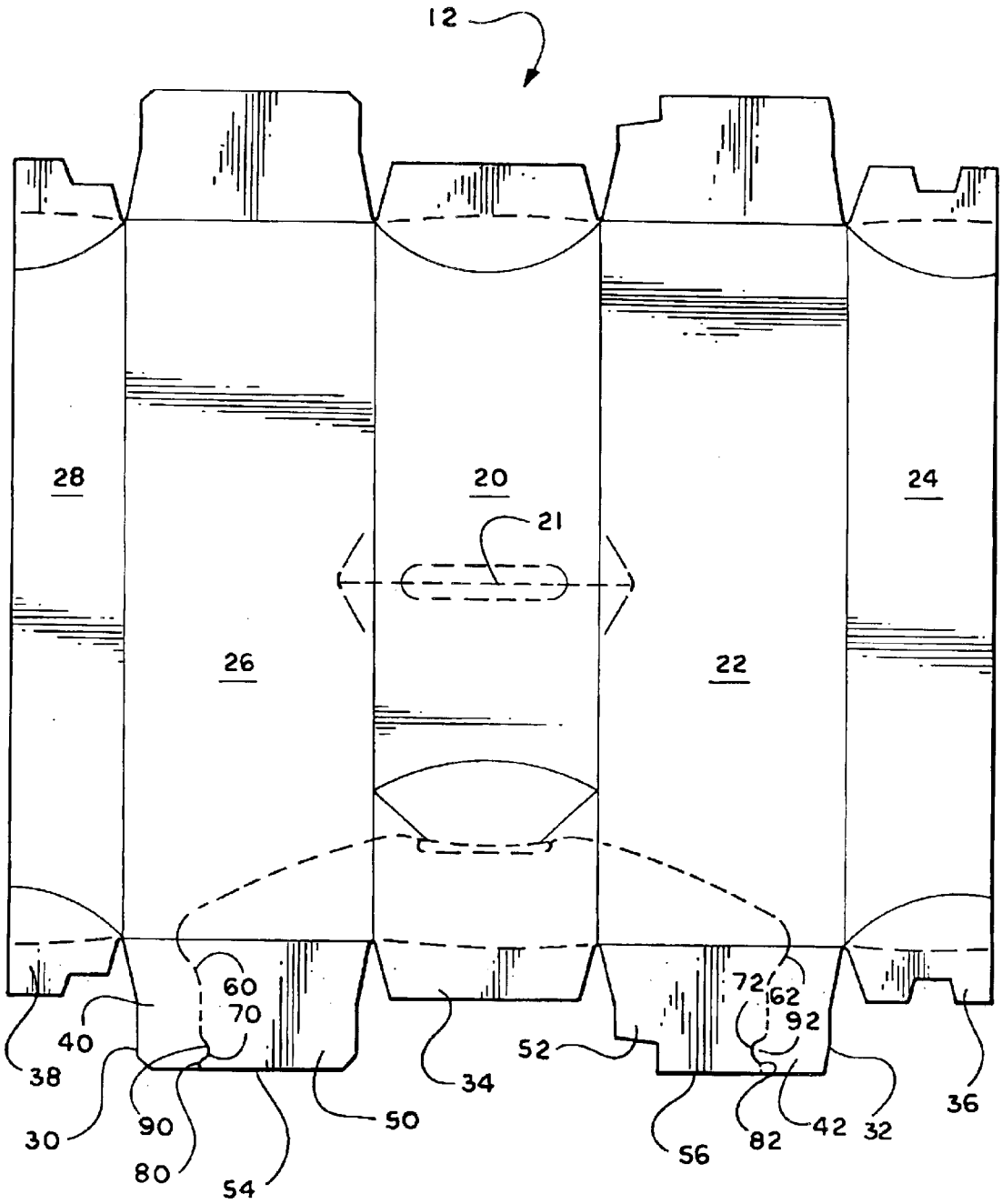
FIG. 5 is a plan of a blank for forming the carton of FIG. 1.

The carton 10 has an end region that terminates in a composite wall formed from panels that overlap along a seam 58. The seam 58 is the overlapping portion between panel edges 54 and 56. In the illustrations of the erected carton, one panel edge 54 or 56 will be shown as hidden through use of a dotted line. For convenience of understanding the carton 10 structure will first be discussed For this purpose, reference is now made simultaneously to FIG. 1 and FIG. 5. FIG. 5 is an illustration of a blank 12 for forming the carton of FIG. 1. The blank 12 is shown from its inner surface. That is, the carton 10 is formed by folding the blank 12 outwardly from the plane in which the illustration lies.

Using the disposition of the carton in FIG. 1 as a point of reference, a top panel, side panels 22, 26, and bottom wall panels 24, 28 are interconnected and form the basic tubular structure of the erected carton 10. A handle 21 is formed in the top panel 20. End structures of the carton are formed from what are typically referred to in the carton field as major and minor flaps.

The terms "flap" and "panel" will be used interchangeably in this discussion. Minor flaps 34, 36, 38 provide innermost closure for the end of the carton 10. For convenience and ease of understanding, the major flaps are described as left and right upper and lower portions. These orientations have been used as an aid in describing the invention and not as limitations upon its teachings. The right major flap (as viewed from a point of orientation facing the page illustrating the erected carton) has lower 40 and upper 50 portions. Likewise, the left major flap has lower 42 and upper 52 portions. Closure of the ends of the carton is accomplished by securing the end regions of the major flaps 40/50, 42/52 to one another in overlapping condition. The overlap of the end regions creates a seam 58 (as briefly mentioned above) defined between the edges 54, 56 of the major flaps.

A frangible line 60, 62 extends across each major panel 40/50, 42/52 and, in the carton illustrated, into other portions of the carton. The full extension of the frangible line defines a trough 100 that is separable from the carton 10. The trough 100 will be discussed later in this description. The frangible line 60,62 is used as a reference point for denoting the lower 40, 42 and upper 50, 52 portions of the major flaps.

The frangible line 60, 62 may be any weakened line that facilitates separation of the panel portions lying on either side of the line. The invention contemplates frangible lines to include but not be limited to perforated lines, tear strips, fold lines and cut lines intermittently joined by nick members. In the carton-making field a "member" is generally considered to be an interconnecting sliver (or similar extremely small portion) of material bridging disjoined portions of material.

The frangible line that extends across the end wall of the carton results from the coincidence of the frangible line 60, 62 that extends across each major end flap 40/50, 42/52. Each frangible line segment that extends across the major flaps terminates at an edge 54, 56 of each major flap 40/50, 42/52. Each segment of the frangible line that extends across the seam (that is, the overlapping or overlapable portion of the major flap) is extensively weakened. That is, is more weakened than the other portion of the frangible line to enable even greater ease of separation. The extensively-weakened segments 70, 72 lie adjacent the edges of the major flaps. Extensive weakening may be accomplished by a deeper score or a more severely interrupted perforated line. In one aspect of the preferred embodiment of the invention, extensive weakening is accomplished by creating a cut line.

In a further aspect of the preferred embodiment, each extensively-weakened line segment 70, 72 includes a nick member 80, 82 near the line segment's 70, 72 intersection with the flap edge 54, 56, particularly when a cut line is used The nick member helps stabilize the edge region of the flap during erection of the blank 12 into a carton 10.

Figure 2:
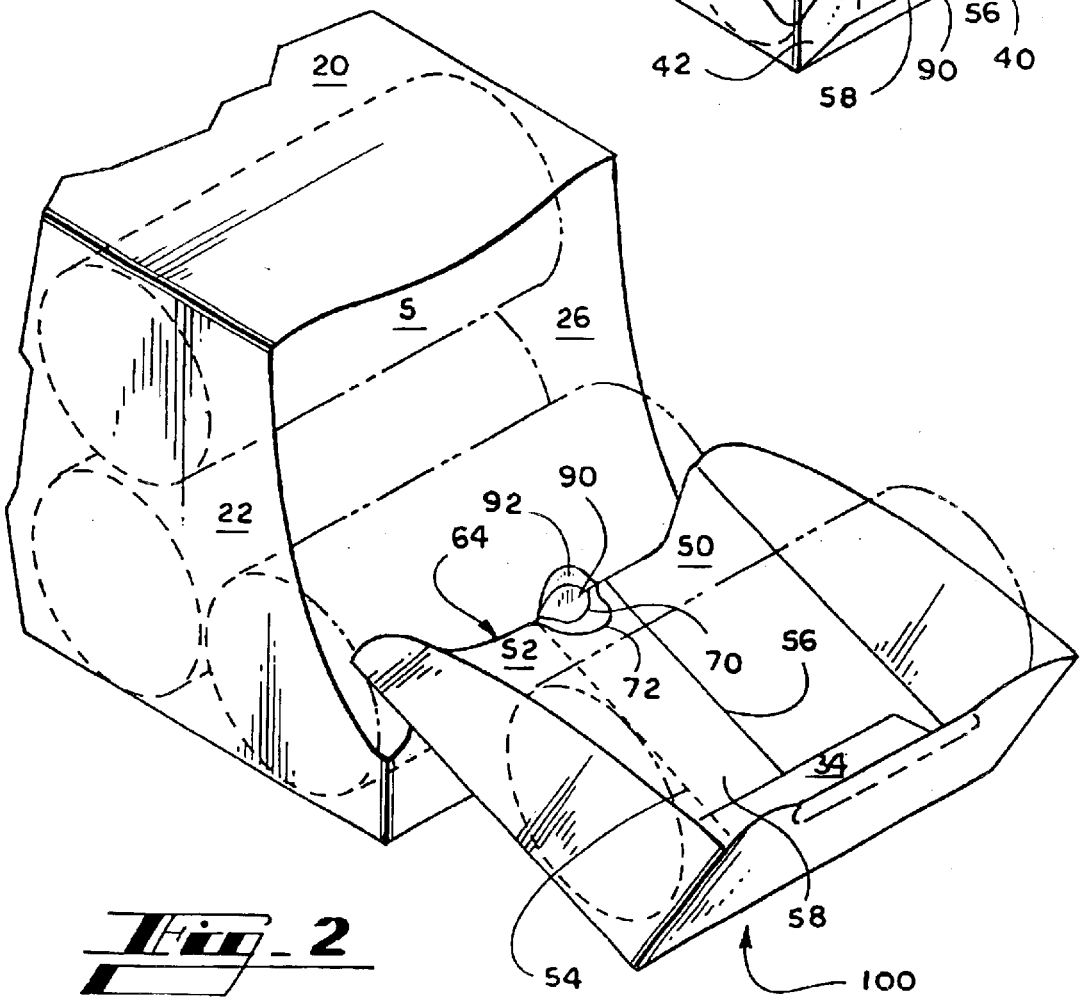
FIG. 2 is a perspective view of the carton of FIG. 1 wherein a trough that is hinged to the carton along a frangible line also serving as a severance line has been flipped down.

The frangible line 60, 62 creates a line along which portions of the carton wall that lie on either side of the line may be severed from one another. The frangible line also creates a hinge about which the opposing panel portions may be pivoted with respect to one another. Reference now may also be made to FIG. 2 wherein the frangible line serves as a hinge 64 between lower 40, 42 and upper 50, 52 major flap portions. The hinged portions may thereafter also be separated from one another by tearing along the hinge/frangible line. The extensively-weakened line segment 70, 72 of the frangible line helps lessen or eliminate the impact of the reinforced carton region resulting from the seam 58. Along the extensively-weakened segments 70, 72 there is no carton material that will inhibit tearing or bending. At most, only an adhesive such as glue that may be used in joining the flaps will be present.

In accordance with another aspect of a preferred embodiment of the invention, the extensively-weakened line segments 70, 72 are arcuate. The arcuate line segment configuration facilitates greater ease of clean separation of panel portions and lessens the tendency of the panels to de-laminate at the seam 58. The curvature of the arcuate segments produces an offset between the line where tearing or shearing stresses are being primarily applied and the region of the seam 58 where stresses are applied. In the case where the lower and upper portions of the end wall are pivoted out of a single plane along the hinge formed by the frangible line, as illustrated in FIG. 2, the offset created by the curvature causes opposing panel portions to completely sever from one another on either side of the extensively-weakened, or cut, line. Thus, there is no connection of wall or panel portions across the seam 58 at this juncture. Once the seam has been eliminated, tearing along the frangible line is easily accomplished. The curvature of the arcuate line segments also results in the creation of protrusions 90, 92 on one side of the line segments and notches on the opposing side. The protrusions are reinforced because of the panel overlap. Thus, as can be seen in FIG. 2, an upright member is created in the erected carton that helps facilitate separation of the wall/panel portions along the seam 58.

Figure 6:
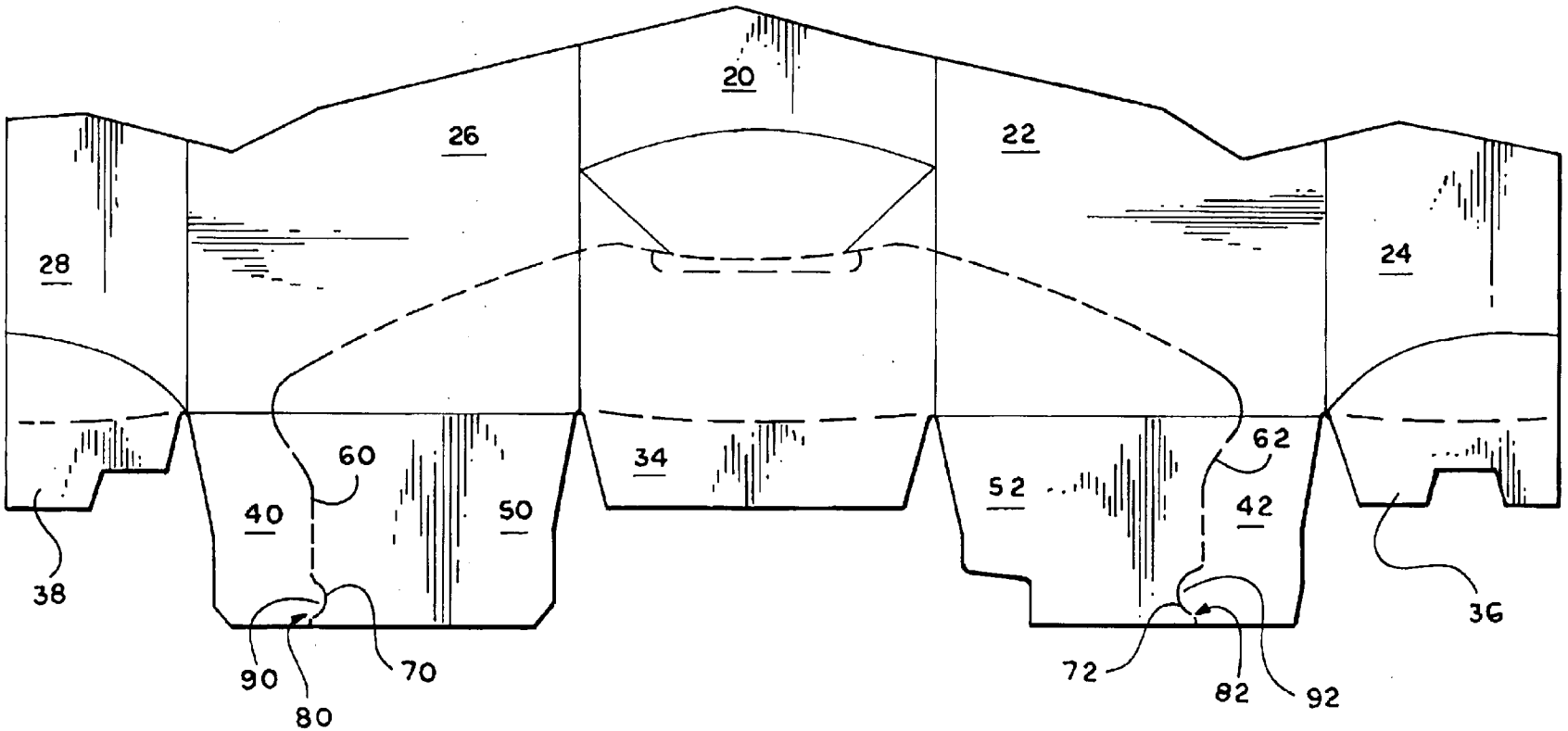
FIG. 6 is an enlarged plan view of a portion of the blank of FIG. 5.

The line segments are disposed for substantial alignment with respect to one another when the edge regions of the major flaps are overlapped and joined to one another. Although the invention teaches substantial alignment of the lien segments 70, 72, in accordance with another aspect of the preferred embodiment, this alignment also contemplates a slight offset between arcuate segments. This offset is accomplished when one arcuate segment 72 has a curvature greater than the other arcuate segment 70. The difference in degree of curvature of the line segments 70, 72 can be more clearly seen in the enlarged view of a portion of the blank 12 illustrated in FIG. 6 and in the trough illustrations of FIGS. 3 and 4 (which will be described in greater detail below). The resulting difference in size of protrusions 90, 92 can be seen in the exaggerated depiction of these features in FIG. 2. When the arcuate segments and protrusions are offset, the lower and upper wall portions may be more easily separated, particularly when pivoted, because clearance between the protrusion and notch is provided for. In the preferred embodiment, the arcuate segment 72 that lies within the inner ply of the seam 58 in flap 52 is made larger than the arcuate segment 70 that lies in the outer ply in flap 50 to provide the necessary clearance.

Figure 3:
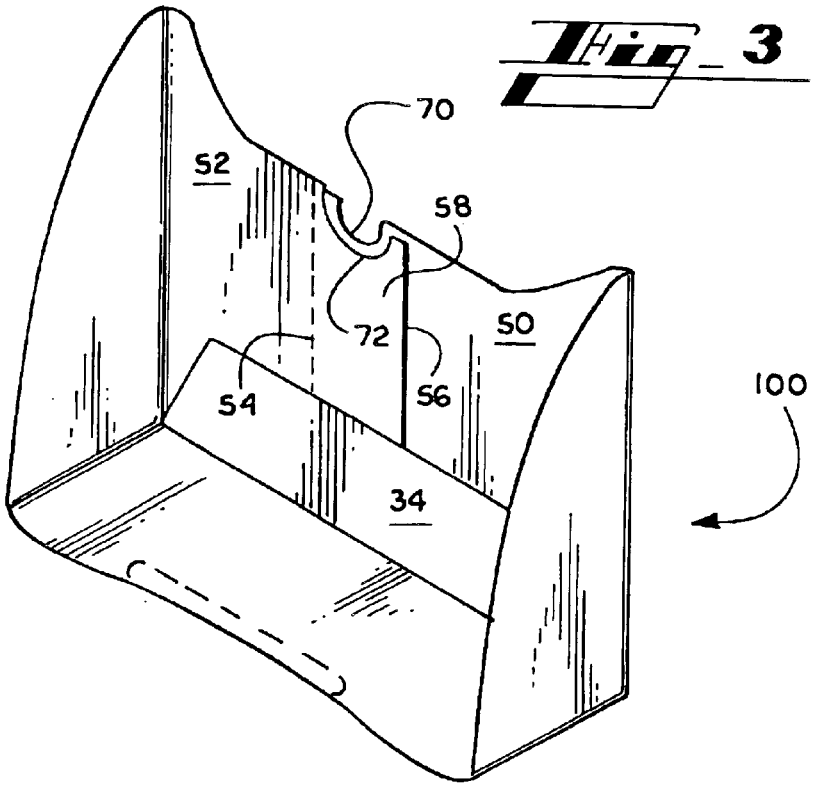
FIG. 3 is a perspective view of the trough of FIG. 2 in removed condition with respect to the remainder of the carton.
Figure 4:
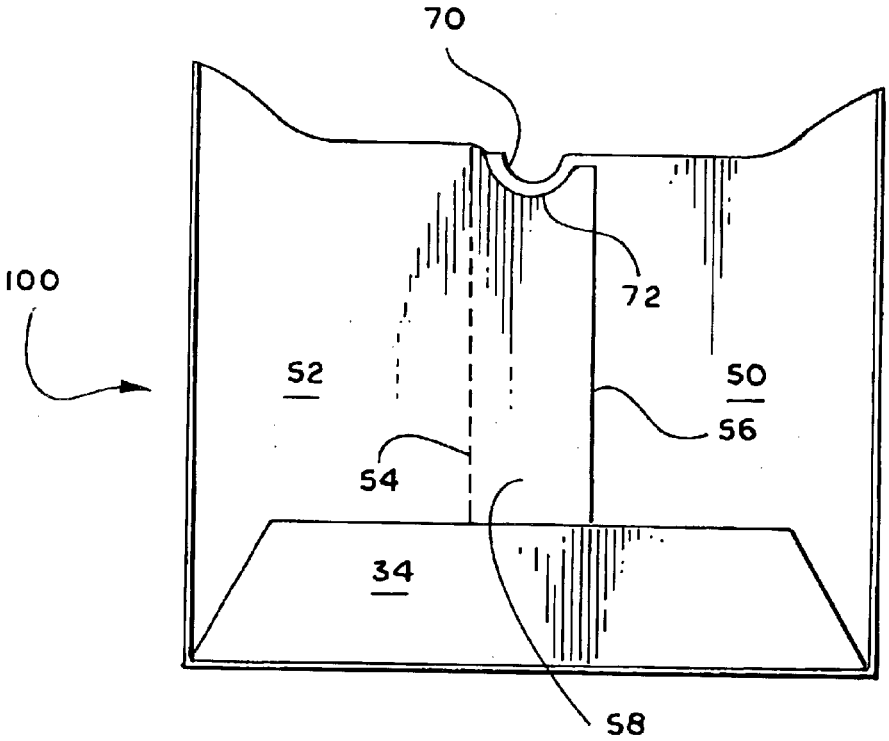
FIG. 4 is an elevational view of the trough of FIG. 3.

The invention is particularly useful in providing a hinge 64 that can subsequently serve as a line of severance for a trough 100 formed at the end of a carton 10. FIGS. 1 and 2 show the manner in which a frangible line inscribes a trough that can be pivoted downward to serve as a receptacle for articles such as cans 5. The pivoted trough can be removed by tearing along the hinge/severance line without resistance from the seam 58. The removed trough is shown in FIGS. 3 and 4. These views also illustrate the offset of the arcuate lien segments 70, 72 discussed above.

The invention provides a means for reliably severing a carton panel across a seam while maintaining the integrity of the carton formation process. The invention essentially offsets a region of reinforcement (created by the seam) from the line of severance (a frangible line). Because of the teachings of the invention, severance of a carton wall at a predetermined region is attainable in a carton that has been formed in a typical manner with seams disposed as appropriate for its function. The invention enables a severance mechanism to be utilised without being limited by the disposition of a carton seam. As illustrated above, the invention is particularly useful in the case where the line of severance serves as a hinge prior to severance. In this manner, the reinforced seam is even further isolated from the line of severance.

Use of terms such as top, bottom, side, end, longitudinal and transverse are used for convenience and to provide a point of reference in the description of the preferred embodiment of the invention and are not meant to limit the scope of the invention. Modifications may be made in the foregoing without departing from the scope and spirit of the claimed invention.

What is claimed is:

1. A severable carton wall comprising:

a composite wall formed from a pair of overlapping panels joined along a seam, said seam comprising an overlap of respective end portions of said panels; and a frangible line extending across the composite wall, traversing the seam, defining a a removable portion of said composite wall;

wherein a segment of the frangible line that traverses the seam is an extensively-weakened segment, and wherein the extensively-weakened segment is arcuate in shape and disposed such that the extensively-weakened segment defines a notch in said removable portion within said seam of said removable portion, and said extensively-weakened segment includes a pair of arcuate cut lines formed respectively in said end portions of said panels, said arcuate cut lines having different radii and being radially offset from each other to facilitate severance of the composite wall along said arcuate segment.

2. The invention of claim 1, wherein the cut line in the panel that is disposed outermost with respect to the seam has a first radius at least slightly smaller than a second radius of the cut line of the innermost panel.

3. The invention of claim 1, wherein each of said cut lines terminates at a nick member disposed proximate an end edge of a respective one of the panels.

4. The invention of claim 1, wherein said arcuate cut lines are disposed generally concentrically with each other.

5. The invention of claim 1, wherein said arcuate cut lines extend alongside each other such that a clearance is provided between said cut lines.

6. The invention of claim 5, wherein said clearance is a radial clearance.

7. The invention of claim 1, wherein said arcuate cut lines are out of alignment in a radial direction.

8. A carton comprising:

top, bottom and a pair of side walls interconnected to form a substantially tubular structure having at least one end region terminating in a composite end wall having a seam, said composite end wall being formed from a pair of overlapping panels joined together along a seam, said seam comprising an overlap of respective end portions of said panels; and a separable trough formed from a portion of the end region hingably and severably connected to the end wall along a frangible line that traverses the seam;

wherein said frangible line comprises an arcuate segment that traverses the seam and a pair of straight segments extending from the arcuate segment toward said side walls respectively, and wherein the arcuate segment is disposed such that the arcuate segment defines a notch in said trough within said seam of said trough whereby when said trough is partially severed from the carton and pivoted about said straight segments, severance of said trough from the carton along said arcuate segment is facilitated.

9. The invention of claim 8, wherein said arcuate segment includes a pair of arcuate cut lines formed respectively in said end portions of said panels, and wherein said cut lines have different radii and extend alongside each other such that a clearance is provided between said cut lines.

10. The invention of claim 8, wherein said arcuate cut lines are disposed generally concentrically with each other.

11. The invention of claim 9, wherein said clearance is a radial clearance.

12. The invention of claim 9, wherein said arcuate cut lines are out of alignment in a radial direction.

13. The invention of claim 9, wherein said arcuate cut lines are radially offset from each other.

14. The invention of claim 9, wherein the cut line in the panel that is disposed outermost with respect to the seam has a first radius at least slightly smaller than a second radius of the cut line of the innermost panel.

15. The invention of claim 9, wherein each of said cut lines terminates at a nick member disposed proximate an end edge of a respective one of the panels.

16. The invention of claim 8, wherein the trough is formed in part from the top wall, in part from the end wall and in part from the side walls, the trough being severably connected to the top and side walls.

17. The invention of claim 16, wherein said frangible line is disposed across the end wall and extends into the side walls so that the trough is severably connected to the side walls.

18. The invention of claim 17, wherein said frangible line extends into the top wall such that the frangible line extends across the top wall.

19. A blank for forming an erected carton having a severable carton wall, the blank comprising:

a pair of panels for forming a composite wall joined along a seam in the erected carton; and a frangible line extending across each of the panels, said frangible lines being disposed for defining a line of severance upon erection of the carton, the line of severance extending across said composite wall and traversing the seam in the erected carton;

wherein a segment of each of the frangible lines next to an end edge of a respective one of the panels comprises an arcuate cut line that extends at least partially across the seam in the erected carton so that the arcuate cut lines of said panels together form an extensively-weakened segment of said line of severance traversing the seam in the erected carton, said arcuate cut lines having different radii so that in the erected carton, said arcuate cut lines are radially offset from each other to facilitate severance of the composite wall along said arcuate segment.

20. The invention of claim 19, wherein the cut line in one of the panels has a first radius at least slightly smaller than a second radius of the cut line of the other of the panels.

21. The invention of claim 19, wherein each of said cut lines terminates at a nick member disposed proximate said end edge of a respective one of the panels.

* * * * *